US010590603B2

(12) United States Patent
Sorrentino

(10) Patent No.: US 10,590,603 B2
(45) Date of Patent: Mar. 17, 2020

(54) METHOD FOR PRODUCING AN IMPROVED YANKEE CYLINDER

(71) Applicant: A. CELLI PAPER S.P.A., Capannori (IT)

(72) Inventor: Salvatore Sorrentino, Pinerolo (IT)

(73) Assignee: A. CELLI PAPER S.P.A., Capannori (IT)

( * ) Notice: Subject to any disclaimer, the term of this patent is extended or adjusted under 35 U.S.C. 154(b) by 16 days.

(21) Appl. No.: 15/577,155

(22) PCT Filed: May 18, 2016

(86) PCT No.: PCT/IB2016/052906
§ 371 (c)(1),
(2) Date: Nov. 27, 2017

(87) PCT Pub. No.: WO2016/189430
PCT Pub. Date: Dec. 1, 2016

(65) Prior Publication Data

US 2018/0171556 A1 Jun. 21, 2018

(30) Foreign Application Priority Data

May 27, 2015 (IT) ..... 102015000018356

(51) Int. Cl.

| | |
|---|---|
| ***F26B 13/18*** | (2006.01) |
| ***D21F 5/18*** | (2006.01) |
| ***D21F 11/14*** | (2006.01) |
| ***D21F 5/02*** | (2006.01) |

(52) U.S. Cl.
CPC ..... *D21F 5/181* (2013.01); *D21F 5/021* (2013.01); *D21F 11/145* (2013.01); *F26B 13/18* (2013.01)

(58) Field of Classification Search
USPC ..... 162/207
See application file for complete search history.

(56) References Cited

U.S. PATENT DOCUMENTS

| | | | | |
|---|---|---|---|---|
| 4,320,582 | A | 3/1982 | Klippstein et al. | 34/39 |
| 8,438,752 | B2 * | 5/2013 | Mennucci | D21F 5/021 162/357 |
| 9,206,540 | B2 * | 12/2015 | Lim | D06F 37/20 |
| 2014/0033789 | A1 * | 2/2014 | Krasser | D21F 5/021 72/368 |
| 2016/0130758 | A1 * | 5/2016 | Schmid | D21F 5/021 162/312 |
| 2018/0179705 | A1 * | 6/2018 | Sorrentino | D21F 5/021 |

FOREIGN PATENT DOCUMENTS

| | | |
|---|---|---|
| IT | 276295 | 3/2013 |
| IT | 277281 | 8/2013 |
| WO | WO 2008/105005 A1 | 9/2008 |
| WO | WO 2014/077761 A1 | 5/2014 |

OTHER PUBLICATIONS

International Search Report dated Aug. 17, 2016, issued to International Application No. PCT/IB2016/052906.
Written Opinion of the International Searching Authority dated Aug. 17, 2016, issued to International Application No. PCT/IB2016/052906.

* cited by examiner

*Primary Examiner* — Mark Halpern
(74) *Attorney, Agent, or Firm* — Stein IP, LLC

(57) ABSTRACT

A method for producing a Yankee dryer cylinder, or Yankee cylinder, includes the steps of executing a cylindrical tubular semifinished product made of steel and having a side wall provided with an internal surface and an external surface. A forging step of the cylindrical tubular semifinished product follows for obtaining predetermined thicknesses at the central portion and at the terminal portions of the side wall where the enlarged terminal portions are made. The cylindrical shell is completed executing a plurality of grooves at the internal surface of the cylindrical tubular semifinished product. Then a plurality of longitudinal blind holes are executed at the external surfaces of the enlarged terminal portions of the cylindrical shell. Then, the heads are positioned at each of enlarged terminal portion of the cylindrical shell to which they are fixed by means of studs that pass the blind holes of the shell and respective through holes of which the heads are provided.

11 Claims, 7 Drawing Sheets

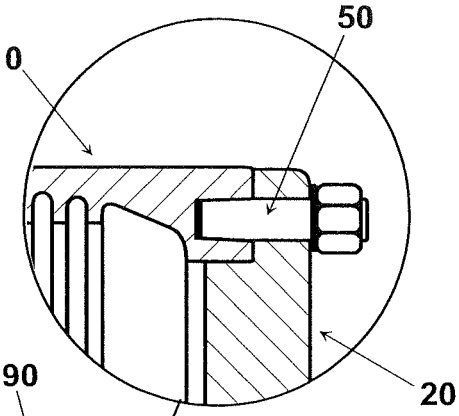
Fig. 3
Fig. 2
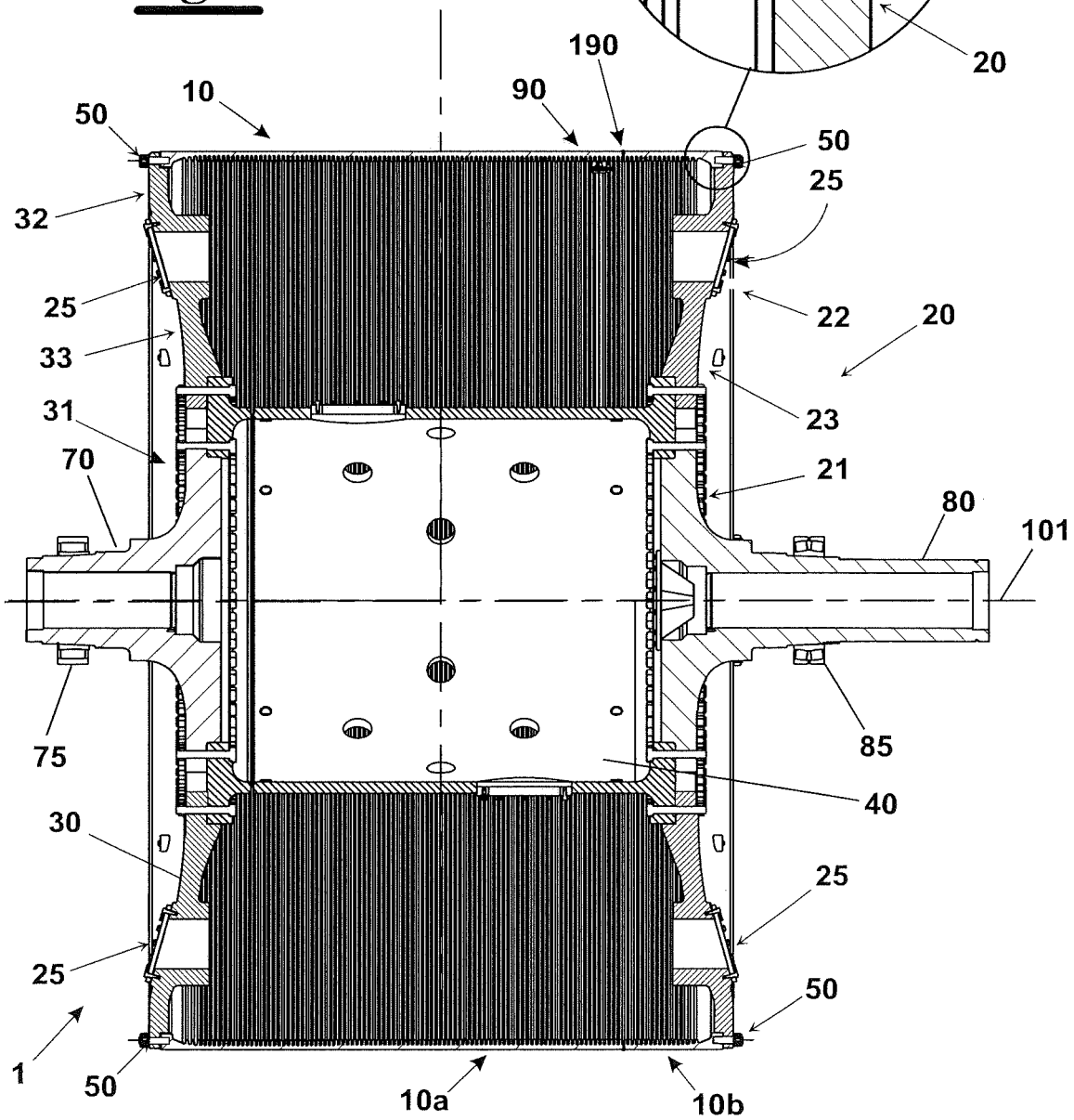

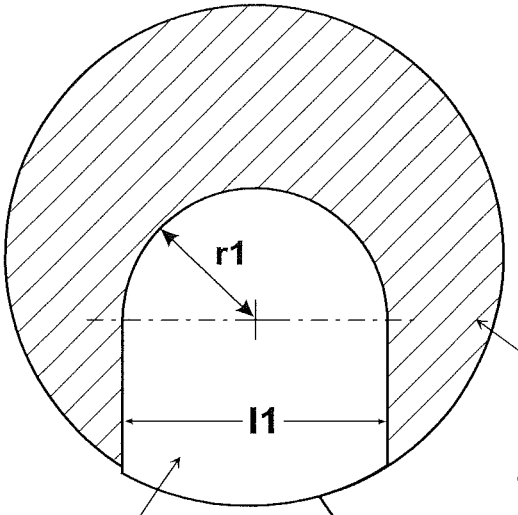
Fig. 8
Fig. 7
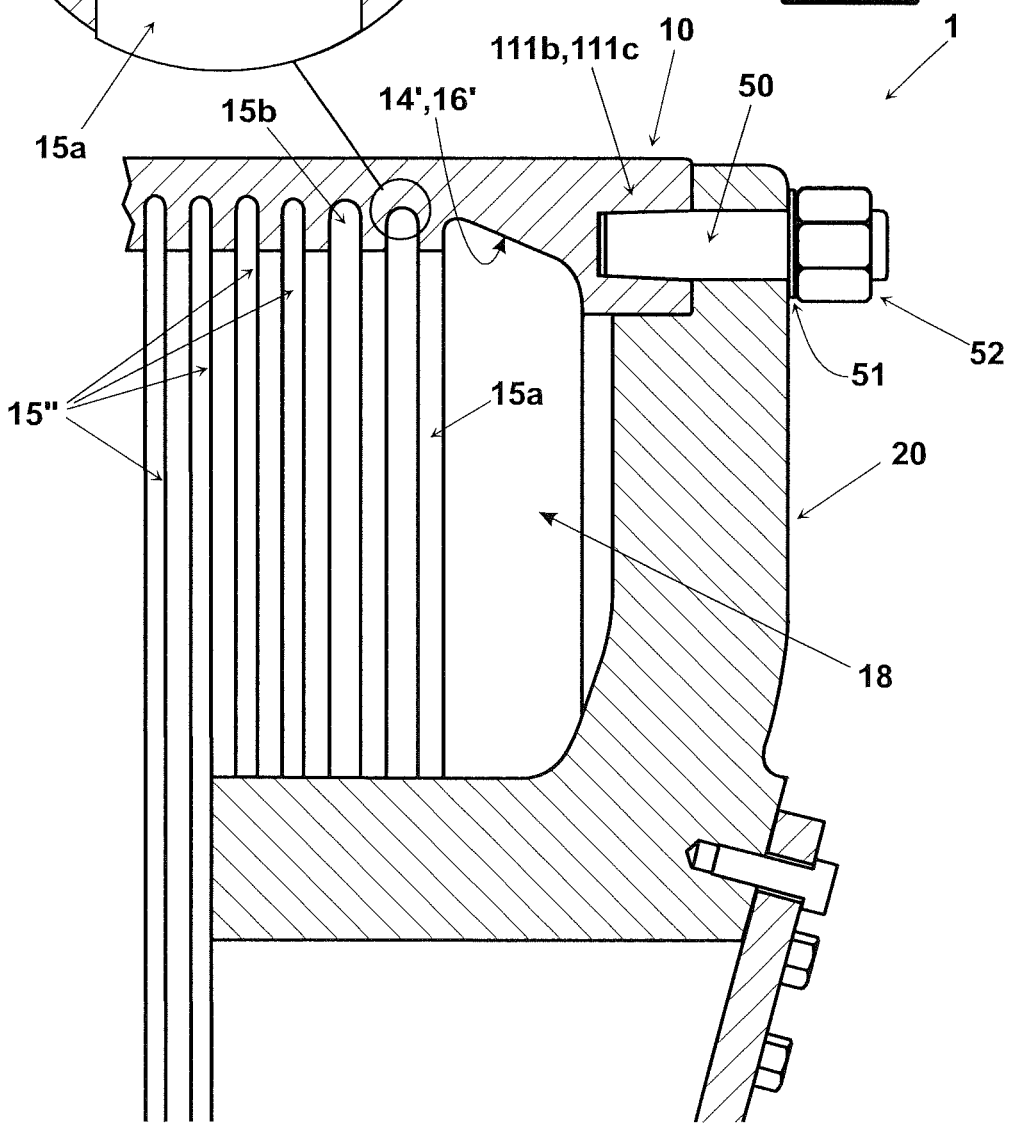

METHOD FOR PRODUCING AN IMPROVED YANKEE CYLINDER

CROSS-REFERENCE TO RELATED APPLICATIONS

This application is a national stage of International Application No. PCT/IB2016/052906, filed May 18, 2016, which claims the benefit of priority to Italian Application No. 102015000018356, filed May 27, 2015, in the Italian Patent Office, the disclosures of which are incorporated herein in their entireties by reference.

DESCRIPTION

Field of the Invention

The present invention relates to the field of machines for producing paper and similar products and in particular relates to a method for producing a dryer cylinder, also known as Yankee cylinder, of improved type, in particular a Yankee cylinder comprising a cylinder made of steel that is not provided with welds.

State of the Art

As well known, the plants for producing paper provide the use of a headbox for distributing a mixture of cellulosic fibres and water on a forming fabric, and sometimes additives of different kinds. In this way, a determined amount of water is drained, thus increasing the dry content of the layer of the mixture that is present on the forming fabric.

The content of water is, then, reduced, through a series of steps among many fabrics and/or felts of the mixture layer, up to obtain a consistency that allows the passage through a drying section. This usually comprises at least a Yankee dryer cylinder, also called "Yankee cylinder" and a drying hood that is fed with hot air. In particular, the web of treated wet paper is laid on the external surface of the Yankee cylinder, whilst the inside of the Yankee dryer cylinder is heated, for example, by introducing steam. The steam produced inside the Yankee dryer cylinder and the hot air, which is blown by the drying hood on the paper, cause the web of wet paper, which is laid on the external surface, to gradually be dried. When the desired value of drying is achieved, the web of paper is removed from the external surface of the Yankee dryer cylinder by means of a blade, or doctor blade, or by means of tensioning according to the desired product and in particular crêpe paper, or smooth paper.

A Yankee dryer cylinder comprises essentially two heads, or end walls, between which a cylindrical shell in positioned. To each head a bearing journal is fixed that is mounted, in operating conditions, on a respective bearing. A hollow shaft is mounted inside the shell. The heads and/or the shell are provided with at least 2 inspection apertures through which at least a worker gets in the cylinder for periodically carrying out normal or extraordinary maintenance interventions.

The constituent elements of the Yankee cylinder, i.e. the heads, the shell, bearing journals etc. can be obtaining by melting of cast iron and can be fixed by bolting.

Alternatively, the Yankee cylinders can be made of steel. In this case the two heads can be fixed to the cylindrical shell by means of screw bolts, or more frequently by means of weld beads.

Both for the Yankee cylinders made of cast iron and made of steel, the cylindrical shell has an internal surface provided with circumferential grooves. These are arranged to collect the condensate that is formed for the transfer toward outside of the latent heat of vaporization from the steam that has been introduced inside the Yankee dryer cylinder.

Normally, the circumferential grooves have the same depth for all the length of the shell. See, for example, the document WO2008/105005 in this respect.

In WO2014/077761 is, instead, disclosed a Yankee dryer cylinder made of steel and comprising a cylindrical shell to which 2 heads are fixed, at opposite sides, by means of respective weld beads. The cylindrical shell has an internal surface provided with circumferential grooves. Normally, the depth of the circumferential grooves gradually increases going from the most external grooves to the most internal grooves, i.e. the thickness of the cylindrical shell decreases. In the document it is explained that this kind of geometry allows to simplify the production of the Yankee cylinder.

This technical solution, already largely used in the state of the art, and for example disclosed in the Italian patents IT276295 and IT277281 in the name of the same Applicant of the present application allows to make the cylinder highly resistant to stresses to which it is subjected in operating conditions, and at the same time to simplify the production with respect to other known solutions. Nevertheless, all the Yankee cylinders of prior art, above disclosed, have many drawbacks.

In operating conditions, the Yankee cylinders are subjected to high stresses, mainly thermoelastic stresses, due to the high temperature of the steam that is introduced, to pressure stresses, compressive forces and to the stresses due to the centrifugal force acting during the rotation of the cylinder about the rotation axis. Normally, the highest values both of the thermoelastic stresses and of the pressure stresses are recorded at the contact zones between the heads and the shell.

In fact, in operating conditions, the pressure deforms the shell and the heads in a different way. Therefore, the contact zones between the shell and the heads are the most stressed zones.

In the Yankee cylinders of prior art, which are obtained welding the shell made of steel to the heads, these too, made of steel, the zones where the welds, which weaken the structure, are executed, are the most stressed zones of all the structure. Analogous drawbacks have been shown also if bolts are used to connect the heads to the shell. In fact, at the end of the Yankee cylinder assembly, not rarely, portions of screws protrude from the side of the shell at the contact zones between the shell and the heads. The protruding portions of screws, in operating conditions, cause the stresses to concentrate at the connection zones.

Therefore, the stresses to which the Yankee cylinder is subjected concentrate at the connection zones between the shell and the heads and therefore, in operating conditions, cracks and slits can happen that can cause, over time, the structure to be broken.

This determines the need to periodically carry out controls for verifying that structural failures are not present and however this causes a short service life of the Yankee cylinder.

A Yankee cylinder having analogous drawbacks is disclosed in U.S. Pat. No. 4,320,582.

SUMMARY OF THE INVENTION

It is, therefore, an object of the present invention to provide a method for producing a Yankee cylinder that, in operating conditions, with respect to the Yankee cylinders of prior art, allows to provide a more uniform distribution of the stresses, in particular of the thermo-elastic stresses, of the pressure stresses and of the stresses produced by the centrifugal force, allowing to increase the performances and the service life of the cylinder.

This and other objects are achieved by a method for producing a Yankee dryer cylinder comprising the steps of:

executing a cylindrical tubular semifinished product made of steel having a side wall provided with an internal surface and an external surface;

forging said cylindrical tubular semifinished product up to obtain a first predetermined thickness s1 at a central portion of said side wall and a second predetermined thickness s2, with s2>s1, at opposite terminal portions of said side wall, in such a way to obtain a cylindrical tubular semifinished product with enlarged terminal portions;

executing a plurality of grooves at said internal surface of said cylindrical tubular semifinished product, thus obtaining a cylindrical shell of said Yankee dryer cylinder;

executing on an external surface of said enlarged terminal portions of said cylindrical shell of a plurality of longitudinal blind holes;

positioning a head at each of enlarged end of said cylindrical shell, each head provided with a plurality of through holes, at the end of said positioning step, each through hole of said plurality being aligned with a respective dead hole of said enlarged terminal portion of said cylindrical shell;

fixing each of said head to a respective enlarged terminal portion of said cylindrical shell by screwing a stud at each couple of dead hole and of aligned through hole.

Preferably, the above said stud is a conical stud.

Advantageously, each of stud is clamped to a respective head by means of a clamping nut. Preferably, an interposition step is provided for interposing a washer made of copper, in particular made of annealed copper, between the head and the clamping nut, in such a way to compensate, in operating conditions, for clearances, if any.

According to the invention, the above mentioned forging step is a rolling carried out by means of at least a first bending roll and a second bending roll arranged, in use, to rotate about a respective rotation axis for exert their action, respectively, on said opposite surfaces of said wall of said cylindrical tubular semifinished product. More precisely, the first and the second bending roll are configured in such a way to provide the first thickness s1 at the central portion of the wall and the above disclosed second thickness s2 at the terminal portions.

In particular, the step of executing the plurality of grooves at the internal surface of the cylindrical tubular semifinished product is carried out by machining.

Preferably, the step of executing a plurality of grooves at the internal surface provides to execute a first and a second group of end grooves at the first and the second terminal portion of the shell. Each of the first and of the second group of end grooves comprises at least a first and at least a second circumferential groove having a width I that increases and a depth d that decreases going towards the enlarged terminal portion of the shell. In this way it is possible to uniformly distribute the loads in operating conditions.

Advantageously, the step of executing the plurality of grooves provides a step of executing a group of central grooves between the first and the second group of end grooves. More precisely, the central grooves have all the same width I that is lower than the width of the end grooves and the same depth d that is greater than the depth of the end grooves.

In particular, at the end of the forging step the enlarged terminal portion is provided with an internal tapered surface which delimits a groove having a width that is greater than the width of the adjacent end groove and a depth that is lower than the depth of the adjacent groove.

In an embodiment of the invention, the step of executing each group of end grooves provides to execute a first, a second and at least a third circumferential groove, at the internal surface of the tubular semifinished product. In particular, the first, the second and the third circumferential groove have a width I that increases and a depth d that decreases going towards the enlarged terminal portion of the shell.

Advantageously, the following steps are furthermore provided:

positioning a hollow shaft within the cylindrical shell;

positioning a first bearing journal at the first head;

positioning a second bearing journal at the second head;

fixing by means of bolts the hollow shaft to the first head, to the second head, to the first bearing journal and to the second bearing journal.

BRIEF DESCRIPTION OF THE DRAWINGS

The invention will be now shown with the following description of its exemplary embodiments, exemplifying but not limitative, with reference to the attached drawings in which:

FIG. 2 diagrammatically shows a Yankee cylinder produced according to the method, according to the invention;

FIG. 3 shows an enlargement of the connection zone between the shell and the head of the Yankee cylinder of FIG. 2 for highlighting some characteristics;

FIG. 7 diagrammatically shows in a vista the connection zone between the shell and the head of the Yankee cylinder of FIG. 6 in a assembled configuration;

FIG. 8 shows an enlargement of the circumferential groove that is the closest to the enlarged terminal portion of the shell;

DETAILED DESCRIPTION OF SOME EMBODIMENTS OF THE INVENTION

Figure 1:
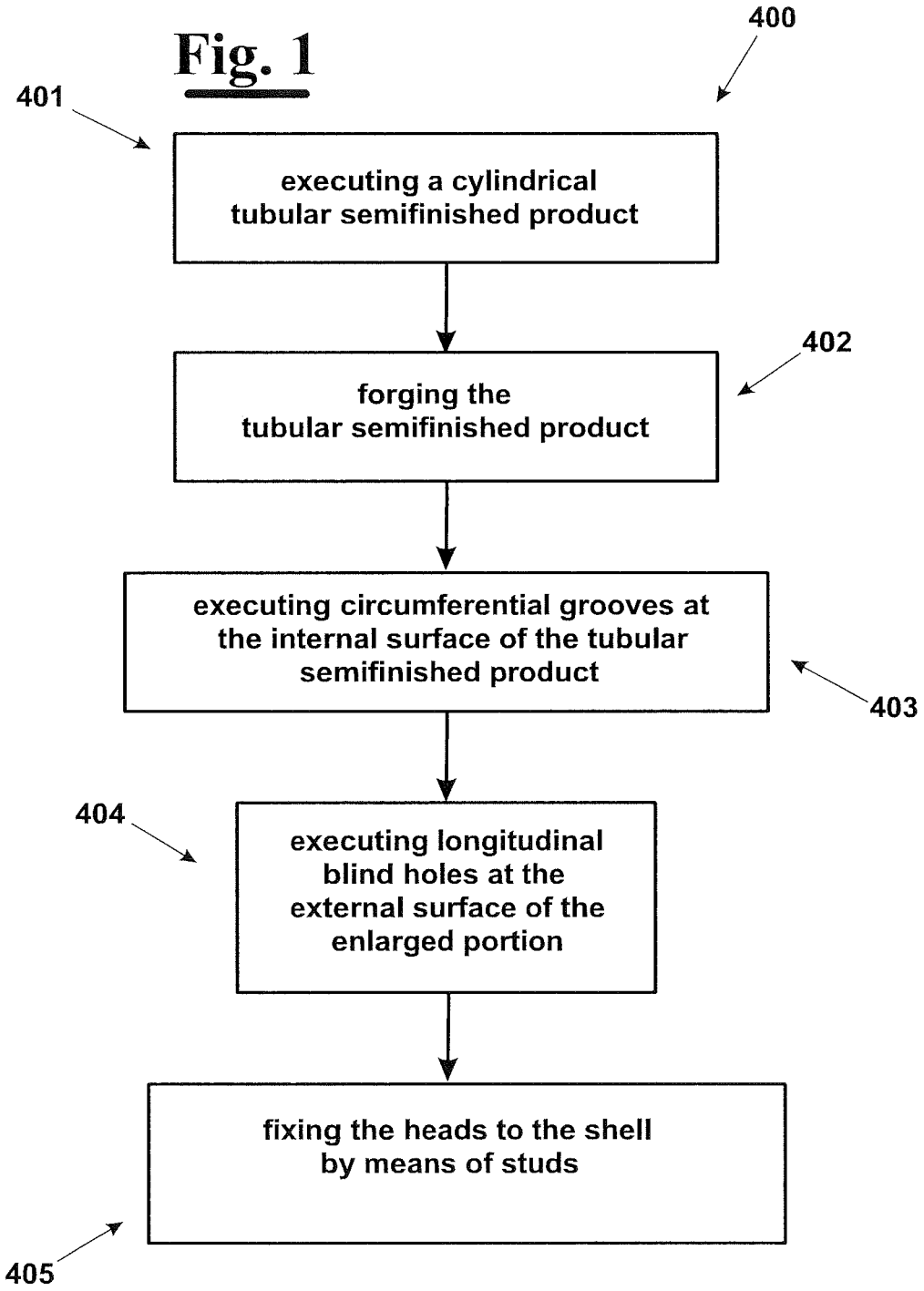
FIG. 1 shows a flow diagram in which the main steps of the method are illustrated, according to the invention, for producing a Yankee cylinder.
Figure 4:
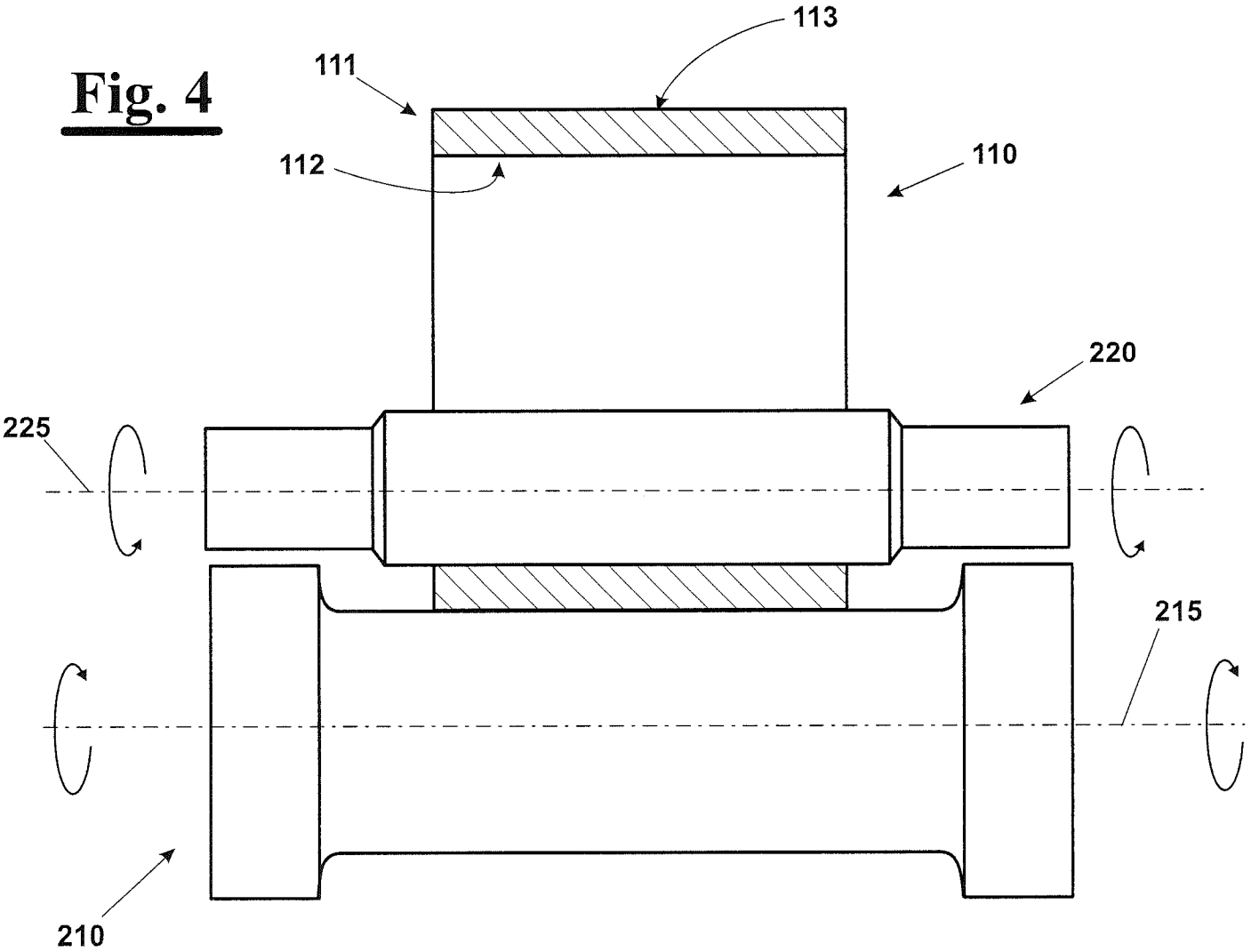
FIGS. 4 and 5 diagrammatically show 2 moments of the step of rolling to which the starting semifinished product is subjected for obtaining the shell of FIG. 2.
Figure 5:
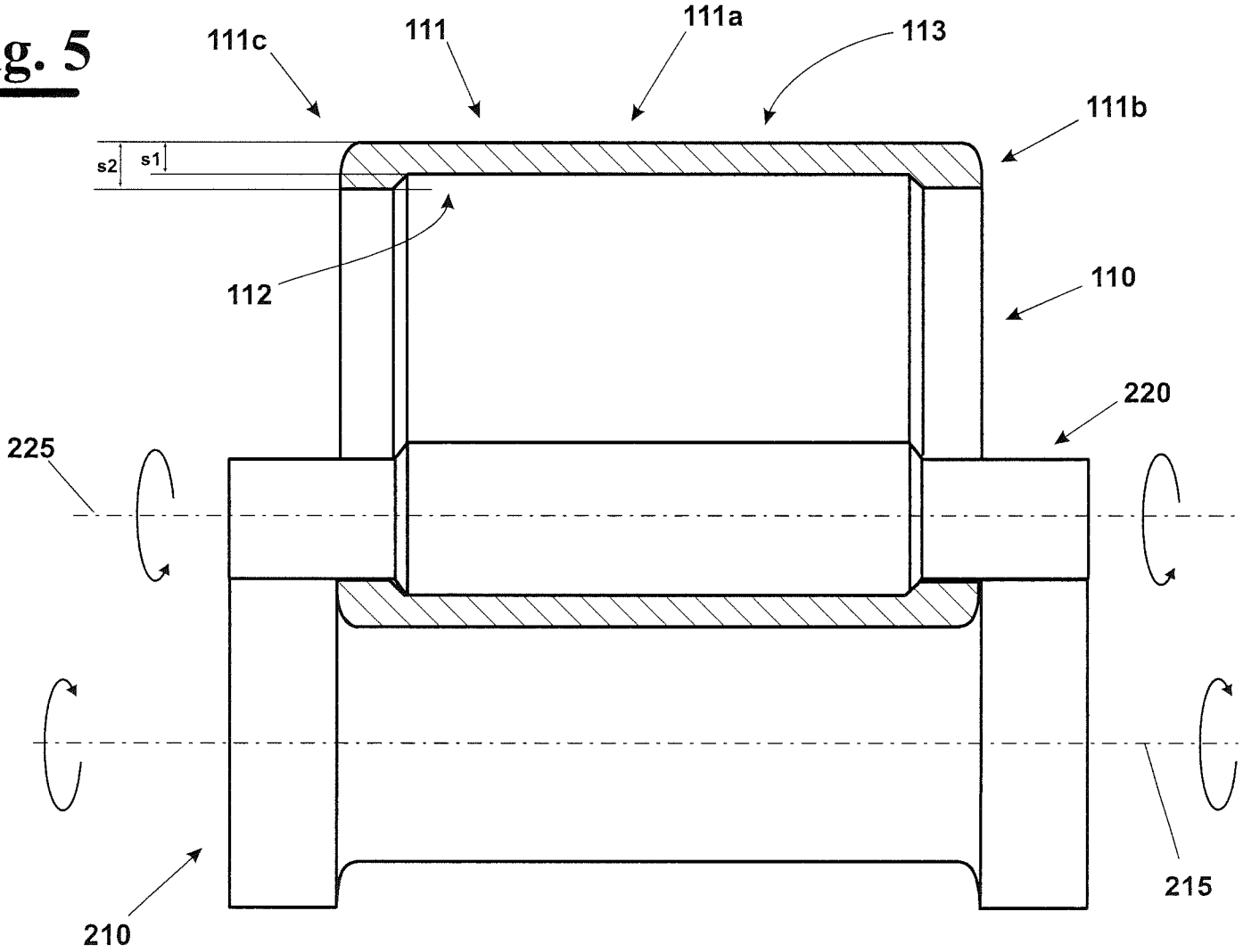
Figure 6:
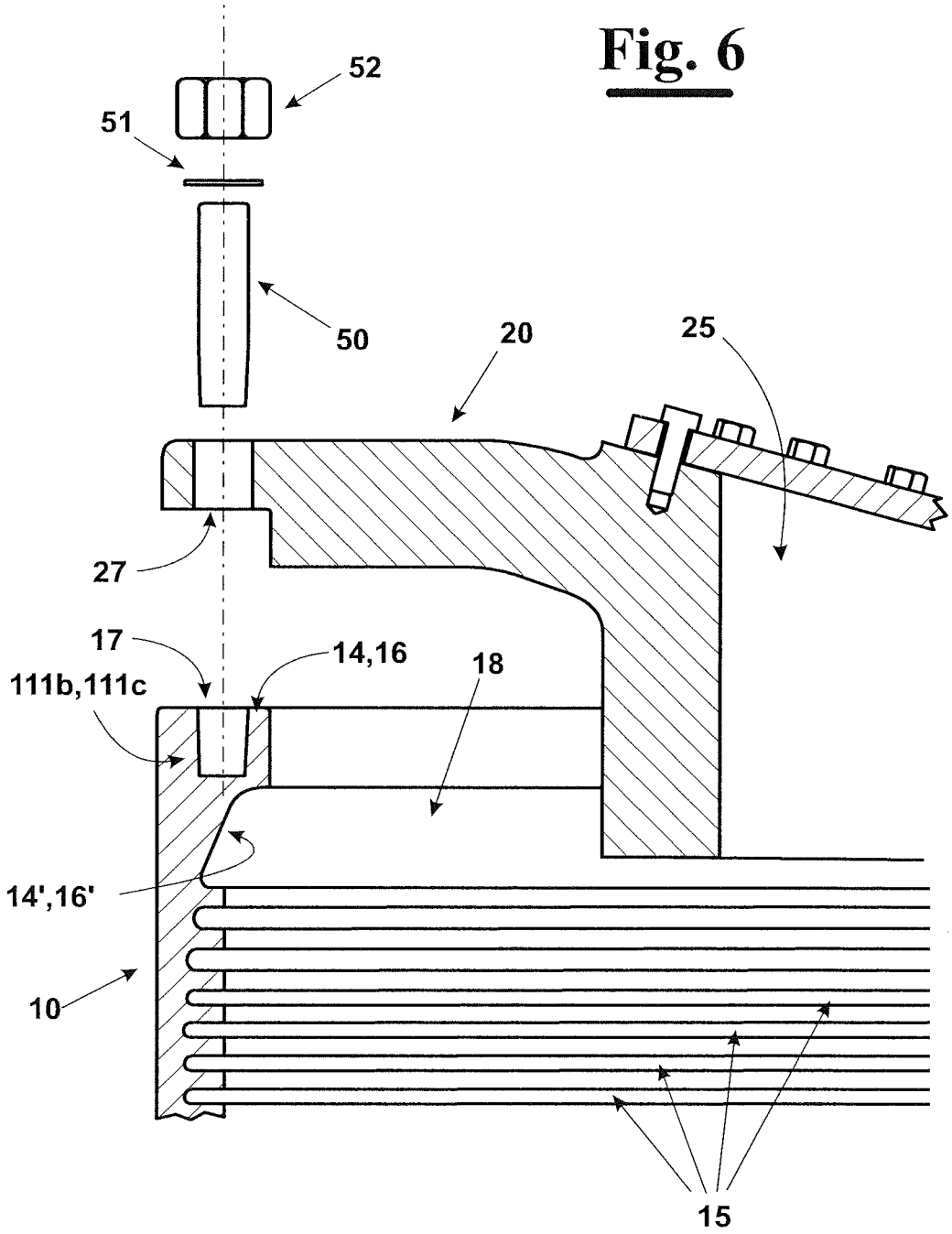
FIG. 6 diagrammatically shows in an exploded view the connection zone between the shell and the head of the Yankee cylinder obtained by the method, according to the invention.

As diagrammatically shown in the block-scheme of FIG. 1, the method, according to the invention, for producing a Yankee dryer cylinder, or Yankee cylinder, provides a starting step of executing a cylindrical tubular semifinished product 110 made of steel having a side wall 111 provided with an internal surface 112 and an external surface 113, block 401. A forging step of the cylindrical tubular semifinished product 110 follows up to obtain a first predetermined thickness s1 at a central portion 111*a* of the side wall 111 and a second predetermined thickness s2, with s2>s1, at opposite terminal portions 111*b*,111*c* of the side wall 111, block 402. In this way a cylindrical tubular semifinished product 110 having enlarged terminal portions 111*b*,111*c* is obtained. Si ha, poi, a step of executing a plurality of grooves 15 at the internal surface 112 of the cylindrical tubular semifinished product 110 obtaining a cylindrical shell 10 of the Yankee dryer cylinder 1, block 402. In particular, the circumferential grooves 15 are executed by machining. As known, in use, inside the circumferential grooves 15 the condensate is formed for the transfer toward outside of the latent heat of vaporization from the steam that has been introduced inside the body of the Yankee cylinder 1.

According to the invention a step is furthermore provided of executing a plurality of longitudinal blind holes 17 at the external surface 14, 16 of the enlarged terminal portions 111*b*,111*c* of the cylindrical shell 10, block 403.

Then, the positioning follows of the heads 20 and 30 at the opposite enlarged terminal portions of the cylindrical shell 10 and the fixing of the same to the shell 10 by means of studs 50, block 404. More precisely, each head 20, 30 is provided with a plurality of through holes 27 each of which, in use, is aligned with a respective dead hole 17. Therefore, the connection of the heads 20 and 30 to the shell 10 is carried out screwing the studs 50 in the holes 17 and 27 positioned aligned, block 405.

The dryer cylinder 1 is, then, completed positioning a hollow shaft 40 within the cylindrical shell 10, coaxially to the same, a first bearing journal 70 at the first head 20, and a second bearing journal 80 at the second head 30. In particular, a first end of each bearing journal 70, 80 is housed, in use, in a hole of a respective head 20, or 30, whereas the opposite end is mounted within a bearing 75, or 85. The hollow shaft 40 is, then, fixed to the heads 20 and 30 and to the bearing journals 70 and 80 by means of bolts.

Figure 9:
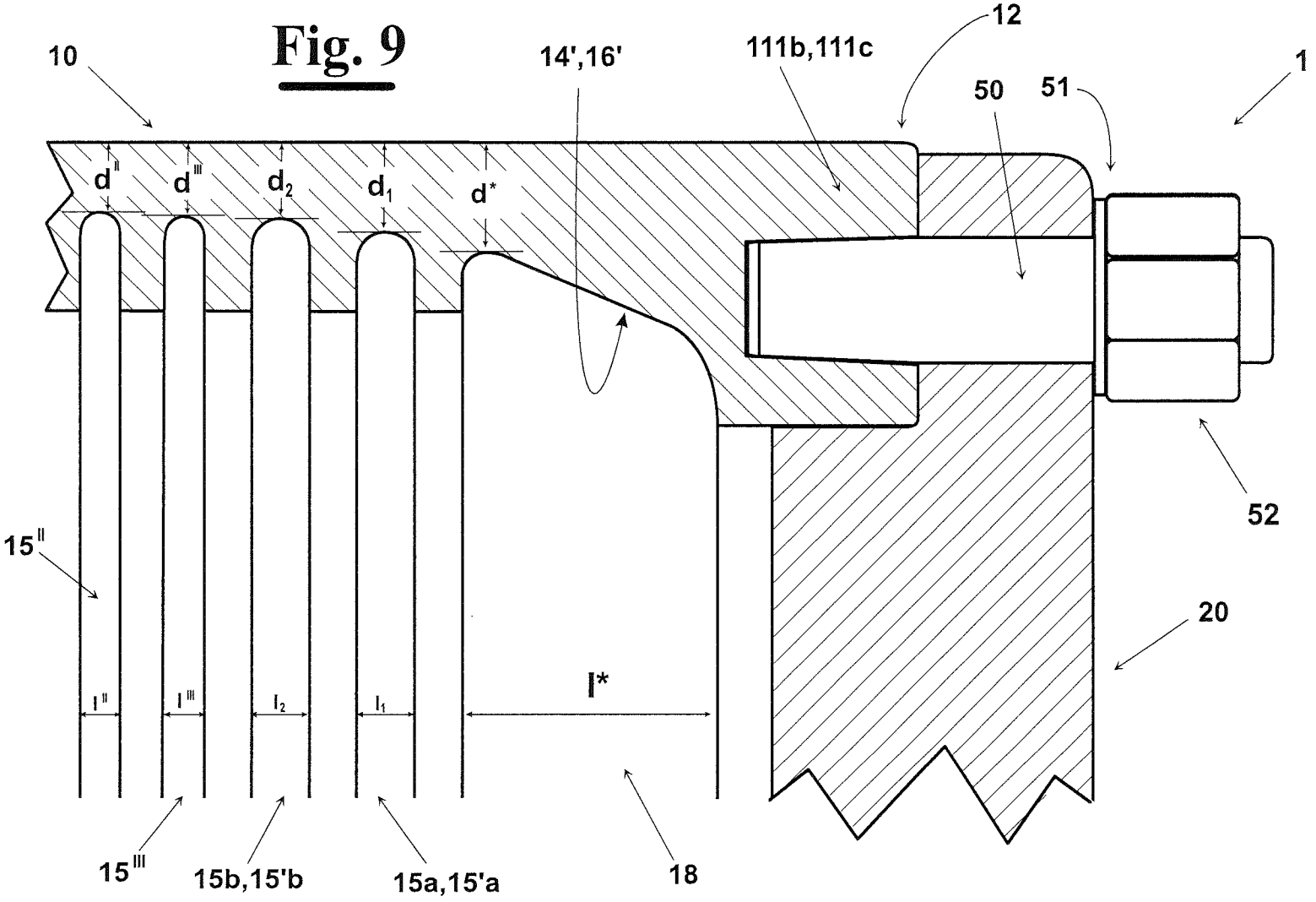
FIG. 9 diagrammatically shows in a cross-section the connection zone between shell and head of a different version of the Yankee cylinder that can be obtained by the method, according to the invention.

As shown in detailed in the FIGS. 7 and 9, the studs that are used for fixing the shell 10 to the heads 20 and 30 are preferably conical studs 50. More precisely, each stud 50 is clamped at a respective head 20, or 30, by a clamping nut 52. Between each nut 52 and the surface of the head 20, or 30, an interposition step is provided for interposing a washer of annealed copper 51. This particular solution allows in operating conditions to compensate for clearances, if any.

The technical solution provided by the present invention allows to obtain a more homogeneous distribution of the stresses, in particular the thermoelastic stresses, the pressure stresses and the stresses due to the centrifugal force, allowing to increase the performances and the service life of the cylinder.

In fact, in operating conditions, the pressure tends to differently deform both the shell and the heads. Therefore, the contact zones between the shell and the heads are the most stressed zones.

For the above discussed reasons, at the connection zones between the shell and the heads concentrate the stresses to which the Yankee cylinder is subjected and therefore, in operating conditions, cracks and slits can happen that can cause, over time, the structure to be broken.

The solution provided by the present invention, instead, allows to increase the thickness of the shell at the terminal portions and at the same time to avoid to introduce elements that weaken the structure as for example welds, or protruding portions of screws. Therefore, in operating conditions, a more uniform distribution of the loads is achieved. A further advantage of using the studs, with respect to the using of the traditional through screws, is to avoid trapping the air in the hole within which the screw is screwed. In fact, the presence of air within the holes, or the hollows, of the structure can cause cracks and slits, because of the high temperatures at which the Yankee cylinders work, the air increases the pressure and therefore produces concentrated stresses.

As diagrammatically shown in the figures the forging step provides a rolling carried out by means of at least a first bending roll 210 and a second bending roll 220 arranged, in use, to rotate about a respective rotation axis 215 and 225 in order to exert their action at the respective opposite surfaces 112 and 113 of the wall 111 of the cylindrical tubular semifinished product 110. More precisely, the bending rolls 210 and 220 are configured in such a way that, during the rolling, the thickness s of the cylindrical tubular semifinished product 110 is reduced to a first value s1 at a central portion and to a second thickness s2, with s2>s1, at the terminal portions.

As shown in detailed, for example in FIG. 7, the step of executing a plurality of grooves 15 at the internal surface 112 provides to execute a first and a second group of end grooves at the first terminal portion 12 and at the second terminal portion 13 of the shell 10. In particular, each group of end grooves comprises at least a first and at least a second circumferential groove 15*a*, or 15*b*, and 15'*a*, or 15'*b* having a width I that increases. More precisely if $I_1$ indicates the width of the groove 15*a* and $I_2$ indicates the width of the groove 15*b*, it is $I1>I_2$. Furthermore, the circumferential end grooves 15*a*, or 15*b*, and 15'*a*, or 15'*b* have a depth d that decreases going towards the enlarged terminal portions 111*b*,111*c* of the shell 10. Therefore, if $d_1$ indicates the depth of the groove 15*a* and $d_2$ indicates the width of the groove 15*b*, it is $d1>d_2$.

This particular geometry of the circumferential grooves 15, together with the absence of welds, or of protruding portions of screws, or bolts, at the side of the shell 10, allow to optimize the performances of the Yankee cylinder 1 with respect to the Yankee cylinders of prior art.

Between the first and the second group of end grooves a group of central grooves is provided having all the same width I, that is lower than the width of the end grooves, and the same depth d, that is greater than the depth of the end grooves.

At the end of the forging step, the enlarged terminal portion 111*b*, 111*c* is provided with an internal tapered surface 14', 16' arranged to delimit a groove 18 having a width I greater than the width of the groove of the adjacent end and a depth d lower than the depth of the adjacent end.

In a different embodiment, furthermore, the step of executing the plurality of grooves 15 at the internal surface 112 provides to make a first groove 15*a*, 15'*a*, of a second 15*b*, 15'*b*, and of at least a third circumferential groove 15*c*, 15'*c* having a width I that increases and a depth d that decreases going towards the enlarged terminal portion 111*b*, or 111*c*, of the shell 10.

In an advantageous embodiment, each head 20, 30 comprises a lowered central portion 21, 31 that is lowered towards the inside of the Yankee cylinder 1 and a terminal portion 22, 32 connected to the lowered central portion 21, 31 by means of a connection portion 23, 33. This can be substantially flat, or curvilinear, i.e. substantially concave. At the connection portion 23, 33 of a head 20, 30 at least an inspection aperture 25 can be provided, for example 2 inspection apertures. These assure that, during the assembly, or maintenance operations, the staff can work in safety. In a possible embodiment each connection portion of each head is provided with 2 inspection apertures arranged at 180°.

In particular, each inspection aperture 25 has a tubular shape. The tubular shape of inspection apertures 25 allows to simplify and improve dynamic balancing of the whole structure and to help the staff to enter inside the Yankee dryer cylinder 1. The tubular entrance of the inspection apertures, furthermore, increases the structural stiffness of the head and therefore of the whole Yankee cylinder.

As shown in detailed in FIG. 8, at least the circumferential grooves 15 of end has a curvilinear profile.

According to the invention, at least these circumferential grooves 15 have a radius of curvature r that is greater than the radius of curvature r" of the circumferential grooves 15 positioned at the central portion 11 of the cylindrical shell 10, i.e. r>r".

More in detail, the radius of curvature r of the first and of the second circumferential groove 15*a*, 15*b* and 15'*a*, 15'*b* of the first and of the second group is set between 9.5 and 10.5 mm, for example r=10 mm.

As shown, for example, in FIG. 9, between each group of circumferential end grooves 15 and the central grooves 15", a group of circumferential intermediate grooves 15'" is provided. In particular, the group of intermediate grooves 15'" comprises at least a circumferential groove having a width l'" that is equal to the width l" of the grooves 15 of the central portion 11, but a depth d between the depth of the adjacent circumferential end groove 15*b*, or 15'*b*, and the depth of the circumferential central grooves 15". In an embodiment provided, also the circumferential grooves 15'" of the group of intermediate grooves have a curvilinear shape. In particular, the circumferential grooves 15'" of the group of intermediate grooves can have a radius of curvature r'" comprises between 6 and 7 mm, preferably r'"=6.4 mm. Also the circumferential grooves 15" positioned at the central portion 11 of the cylindrical shell can have a radius of curvature r" set between 6 and 7 mm, preferably r"=6.4 mm.

Concerning the depth of the first circumferential end grooves 15*a* and 15'*a* has been demonstrated that ideal conditions are obtained with a depth d1 between 25 and 27 mm, preferably d1=26 mm. Analogously, the second circumferential grooves 15*b*, 15'*b* of the first and of the second group preferably have a depth d2 set between 30 and 32 mm, preferably d2=31 mm.

In an embodiment provided by the invention, the circumferential grooves 15'" of the group of intermediate grooves have a depth d'" between 31 and 33 mm, preferably a depth d'"=32 mm.

As for example shown in FIG. 9, an increase of the depth is provided in the first 4 grooves, i.e. d">d'">d2>d1. The grooves 15" of the central portion 11 have the same depth d", e.g. d"=33 mm.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. Method for producing a Yankee dryer cylinder comprising the steps of:

executing a cylindrical tubular semifinished product made of steel having a side wall provided with an internal surface and an external surface;

forging said cylindrical tubular semifinished product for obtaining a cylindrical tubular semifinished product having enlarged terminal portions and comprising a first predetermined thickness s1 at a central portion of said side wall and a second predetermined thickness s2, with s2>s1, at the end of the opposite terminal portions of said side wall;

executing a plurality of grooves at said internal surface of said cylindrical tubular semifinished product, thus obtaining a cylindrical shell of said Yankee dryer cylinder;

executing a plurality of longitudinal blind holes at an external surface of said enlarged terminal portions of said cylindrical shell;

positioning a head at each enlarged terminal portion of said cylindrical shell, each head being provided with a plurality of through holes, at the end of said positioning step each through hole of said plurality being aligned with a respective blind hole of said enlarged terminal portion of said cylindrical shell;

fixing each of said head to a respective enlarged terminal portion of said cylindrical shell by screwing a stud to each couple of aligned blind holes and of through holes.

2. Method for producing a Yankee dryer cylinder according to claim 1, wherein said stud is a conical stud.

3. Method for producing a Yankee dryer cylinder according to claim 1, wherein each of said stud is clamped to a respective head by a clamping nut, and wherein an interposition step is provided of interposing a washer made of copper, between said head and said clamping nut, thus compensating clearances, in operating conditions, if any.

4. Method for producing a Yankee dryer cylinder according to claim 1, wherein said forging step is a rolling carried out by means of at least a first bending roll and a second bending roll arranged, in use, to rotate about a respective rotation axis in such a way to exert their action, respectively, on said opposite surfaces of said wall of said cylindrical tubular semifinished product, said first and said second bending roll being configured in such a way to provide said first thickness s1 at said central portion of said wall and said second thickness s2 at said terminal portions.

5. Method for producing a Yankee dryer cylinder according to claim 1, wherein said step of executing a plurality of grooves at said internal surface provides to execute a first and a second group of end grooves at said first and at said second terminal portions of said cylindrical shell, each of said first and second group of end grooves comprises at least a first and at least a second circumferential groove having a width l that increases and a depth d that decreases going towards said enlarged terminal portion of said shell, in such a way to uniformly distribute the loads in operating conditions.

6. Method for producing a Yankee dryer cylinder according to claim 5, wherein between said first and said second group of end grooves a group of central grooves is provided having all the same width l lower than the width of said end grooves and the same depth d greater than said depth of said end grooves.

7. Method for producing a Yankee dryer cylinder according to claim 6, wherein said step of executing a plurality of grooves at said internal surface provides to execute a group of intermediate grooves between each of said first and second group of circumferential end grooves and said central grooves, said group of intermediate grooves comprising at least a circumferential groove having a width that is equal to the width of said grooves of said central portion of said side wall, but a depth d''' set between the depth of the adjacent circumferential end groove and the depth d'' of the circumferential central grooves.

8. Method for producing a Yankee dryer cylinder according to claim 6, wherein said circumferential grooves have a curvilinear profile and wherein said circumferential grooves of said first and said second group of end grooves have a radius of curvature r greater than the radius of curvature r'' of the circumferential grooves of said central group, said radius of curvature r being set between 9.5 and 10.5 mm.

9. Method for producing a Yankee dryer cylinder according to claim 5, wherein at the end of said forging step said enlarged terminal portion has an internal tapered surface arranged to delimit a groove having a width that is greater than the width of the adjacent end groove and a depth that is lower than the depth of the adjacent groove.

10. Method for producing a Yankee dryer cylinder according to claim 1, wherein, furthermore, the steps are provided of:

positioning a hollow shaft within said cylindrical shell;

positioning a first bearing journal at said first head;

positioning a second bearing journal at said second head; and fixing by means of bolts said hollow shaft to said first head, to said second head, to said first bearing journal and to said second bearing journal.

11. Method for producing a Yankee dryer cylinder according to claim 1, wherein each of said stud is clamped to a respective head by a clamping nut, and wherein an interposition step is provided for interposing a washer made of annealed copper, between said head and said clamping nut, thus compensating clearances, in operating conditions, if any.

* * * * *